United States Patent [19]

Balkus

[11] 4,354,537

[45] Oct. 19, 1982

[54] WOOD SPLITTING DEVICE

[76] Inventor: Carl E. Balkus, 176 Deepwood Dr., Amston, Conn. 06231

[21] Appl. No.: 301,421

[22] Filed: Sep. 11, 1981

Related U.S. Application Data

[63] Continuation-in-part of Ser. No. 136,330, Apr. 1, 1980, abandoned.

[51] Int. Cl.[3] ..... B27L 7/00

[52] U.S. Cl. ..... 144/193 C; 144/193 H; 254/130

[58] Field of Search ..... 144/193 R, 193 C, 193 D, 144/193 H, 193 K, 193 F; 254/130

[56] References Cited

U.S. PATENT DOCUMENTS 4,244,407 1/1981 McMullin ..... 144/193 H

*Primary Examiner*—W. D. Bray

*Attorney, Agent, or Firm*—McCormick, Paulding & Huber

[57] ABSTRACT

Apparatus for splitting logs including a base, a platform for supporting on end a log to be split, and a post mounted on the base. An axe head with a downwardly directed cutting edge is slideably received on the post which, in turn, is provided with a plurality of recesses facing in the direction of the cutting edge. A link extends between a handle and the axe head and is pivotally connected at its ends to the handle and the axe head. A fulcrum pin at one end of the handle is receivable in one of the recesses when the cutting edge is rested upon an upper end of the log. When a transverse force is applied to the end of the handle distant from the fulcrum pin, the handle is caused to rotate about the fulcrum pin from a raised position toward a lowered position forcing the cutting edge to enter the upper end of the log. With continued rotation of the handle, the cutting edge advances into the log toward its lower end at an ever faster rate, but with ever decreasing force. The location of the fulcrum pin can be readily changed to obtain greater speed or force of the cutting edge through the log. The handle and the axe head may be maintained in a rest position adjacent to the operating position in preparation for placement of another log into position to be split, and a second handle may be provided for an even greater mechanical advantage.

4 Claims, 13 Drawing Figures

FIG. 1
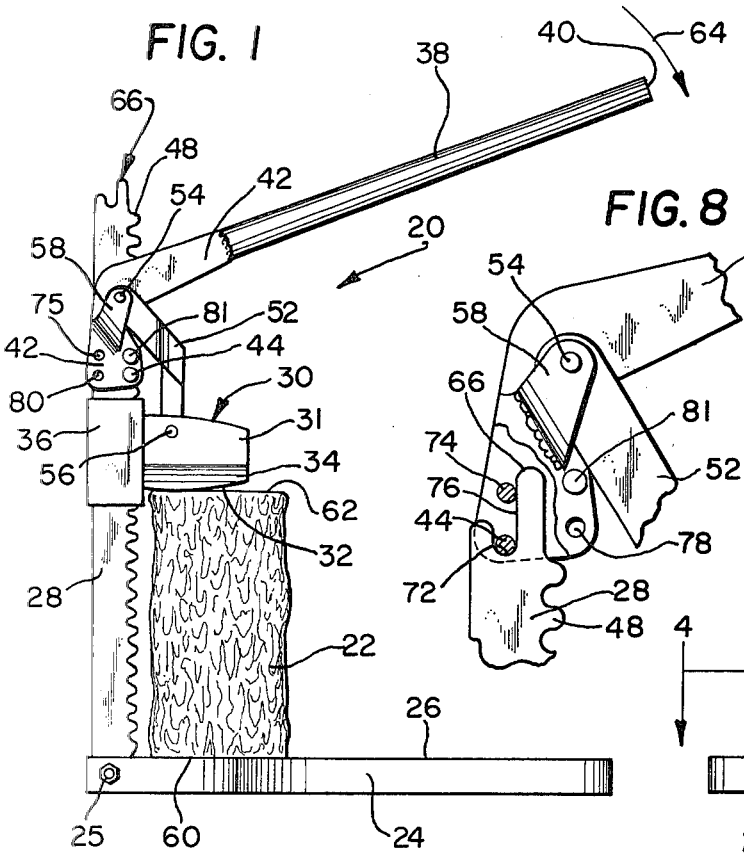
FIG. 8
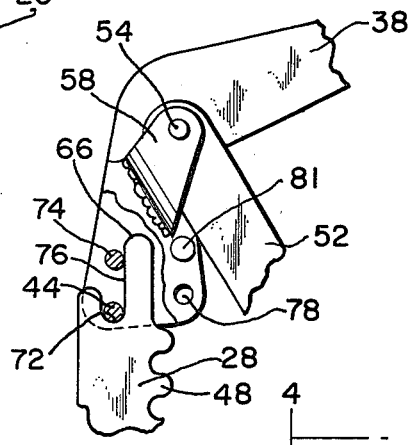
FIG. 2
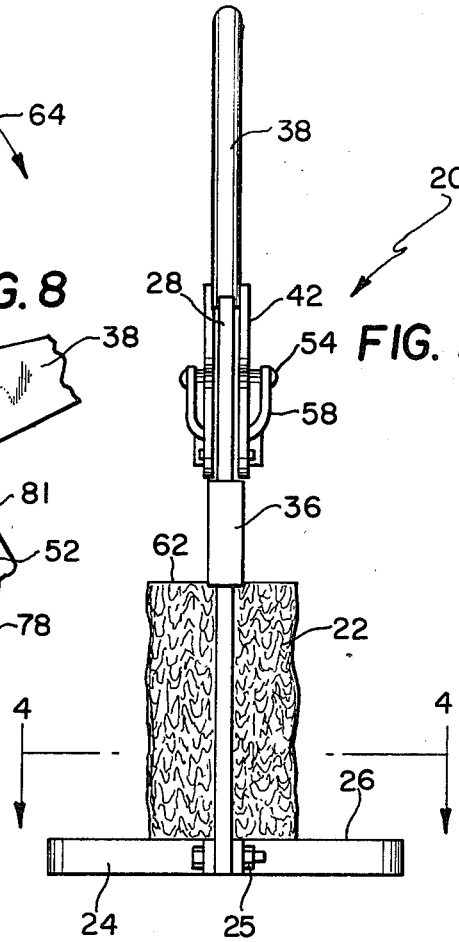
FIG. 3
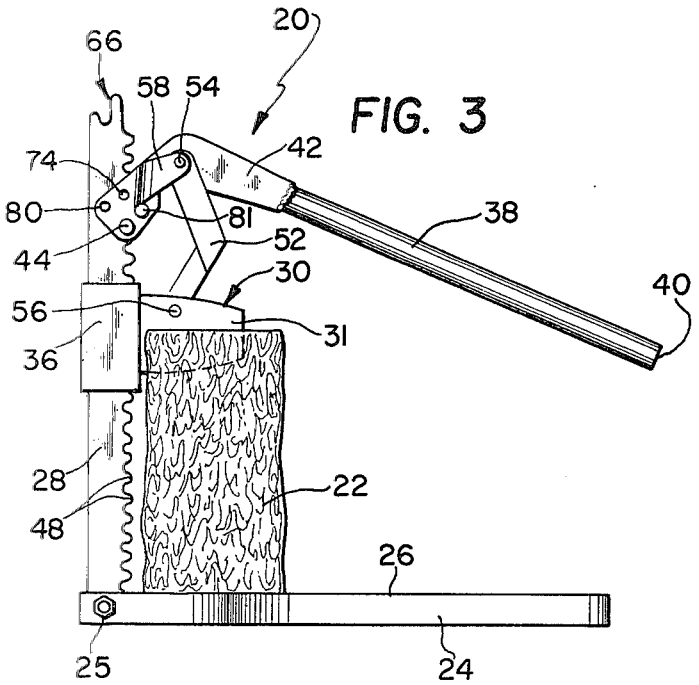
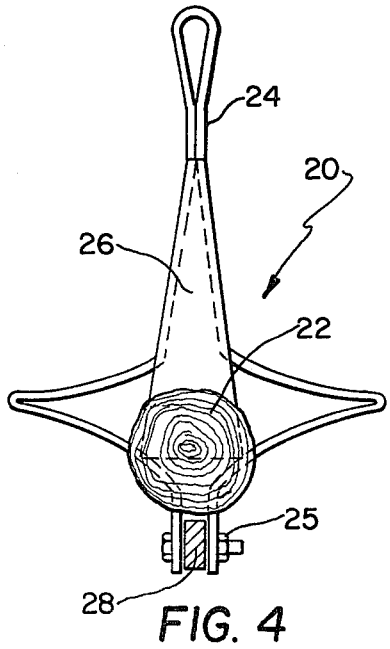
FIG. 4

WOOD SPLITTING DEVICE

CROSS-REFERENCE TO RELATED APPLICATION

This application is a continuation-in-part application of Ser. No. 136,330, filed Apr. 1, 1980, by the applicant herein and having the same title and now abandoned.

BACKGROUND OF THE INVENTION

1. Field of the Invention

The present invention relates generally to improved apparatus for splitting wood in the form of logs which have been previously cut to lengths acceptable for use in a fireplace or stove.

2. Description of the Prior Art

In recent years, energy has come to have an ever higher priority in our society. The constantly increasing prices of oil and natural gas has resulted in a new interest in the use of firewood to supplement, and in some instances, to replace existing home heating systems.

Being generally desirable to employ split wood in a fireplace or wood stove for ease in starting and maintaining the fire, it is necessary for the user to either purchase the wood already split or to split the wood himself. Wood which is already split is generally more costly than unsplit logs. At the same time, it may be difficult for the novice to split logs and, indeed, is an inherently dangerous task. Furthermore, it is time consuming and interruptive of other tasks, even for the person accustomed to it.

In the past, numerous attempts were made to provide devices for the specific purpose of splitting wood. The U.S. Pat. Nos. to Fowler, 53,289, issued Mar. 20, 1866; and to Wagner, 128,830, issued July 9, 1872 are typical of such device which provide a mechanical advantage to the user, the lever providing the mechanical advantage also including an integral blade for engaging and splitting the wood. The U.S. Pat. Nos. to Mors, et al, 280,657, issued July 3, 1883; and to Eiden, 720,010, issued Feb. 10, 1903, disclose more complex devices which employ likages between the operating handle and the blade which is utilized for engaging and splitting the wood. The U.S. Pat. No. to Latus, 168,649, issued Oct. 11, 1875, discloses a somewhat different design in which the base of a pivoted handle is formed as a pinion which engages a rack having an integral blade which is engageable with the end of a log to be split. Movement of the handle, via the pinion and rack, causes the blade to advance into the wood and split it. Also known to the applicant is the Melton U.S. Pat. No. 827,251, issued July 31, 1906, which discloses a timber hewing machine incorporating a ratchet mechanism which constantly assures forward motion of the cutting blade and prevents it from moving backward.

The patents just recited are generally representative of the prior art and, although they were advances in the state of the art at the time that they were conceived, there are a number of drawbacks in the construction of some or all of them which are notable. For example, in many instances, the devices were not readily adjustable to accommodate logs of various sizes. Nor, did the prior patents disclose an ability to quickly reset the splitting device for another stroke through the remainder of the present log or for a stroke through a new log. In many instances, the known devices were heavy and cumbersome so as not to be readily portable. Also, as disclosed, the prior wood splitting devices often did not provide for firmly guiding the blade during the entire splitting process nor was there any provision for enabling a variation in force and speed of the cutting edge as it advances into the log. Another drawback of the known devices was that there was generally no positive provision for holding the handle and blade in inactive positions while removing the split wood and inserting a new log to be split. Furthermore, in some instances, the prior art devices were complex and expensive to manufacture and maintain.

SUMMARY OF THE INVENTION

It was with recognition of the need and of the state of the prior art that the present invention was conceived and has been reduced to practice. To this end, the present invention discloses apparatus for splitting logs including a base, a platform for supporting on end a log to be split, and a post mounted on the base. An axe head with a downwardly directed cutting edge is slidably received on the post, which, in turn, is provided with a plurality of recesses facing in the direction of the cutting edge. A link extends between a handle and the axe head and is pivotally connected at its ends to the handle and the axe head. A fulcrum pin at one end of the handle is receivable in one of the recesses when the cutting edge is rested upon an upper end of the log. When a transverse force is applied to the end of the handle distant from the fulcrum pin, the handle is caused to rotate about the fulcrum pin from a raised position toward a lowered position forcing the cutting edge to enter the upper end of the log. With continued rotation of the handle, the cutting edge advances into the log toward its lower end, initially with slow speed but great force, then continuing at an ever faster rate but with ever decreasing force. The location of the fulcrum pin can be readily changed, selectively, to obtain greater speed or force of the cutting edge through the log. The handle and the axe head may be maintained in a rest position adjacent to the operating position in preparation for placement of another log into position to be split, and a second handle may be provided for an even greater mechanical advantage.

The present invention, as disclosed, is reasonably light, portable, readily usable, employs existing and inexpensive materials, and can be used either out of doors or indoors next to a fireplace or to a wood stove. The invention is readily adjustable to accommodate logs of various sizes to continue splitting of partially split logs until fully split. Also, as disclosed, the blade of the axe head is engaged with an upper end of the log to be split at the outset to prevent the log from moving laterally or tipping over. Provision is made also for holding the handle and the axe head in inactive positions so as to enable removal of the split wood and insertion of a new log to be split. The inactive positions of the handle and axe head are close to their active positions so that it requires but little additional effort to put the device to use.

By reason of the invention's design, as the handle is drawn downwardly, the rate of movement of the blade into the log is very small, but with application of a relatively large force. This relatively large force is of particular importance at the outset to enable the blade to enter the log and initiate the splitting process. With continued movement of the handle, the blade moves faster and faster with ever diminishing force resulting in a rapid and complete splitting of the log being operated upon. Furthermore, if the log is only partially split after a cycle of movement of the handle is completed, the invention can be reset for another cycle for completion of the splitting operation. Sometimes, the weight of the axe head along, first raised by means of the handle, then dropped onto a partially split log, will be sufficient to complete the splitting operation. Such a procedure, for example, can be used when splitting kindling. In some other instances, when the blade has entered the log and is firmy wedged in the log, the axe head and the log can be raised together by the handle, then dropped onto the base as often as necessary to complete the splitting opration.

Since there is no build up of momentum or kinetic energy as with the swing of an axe, and since the blade moves only in a very limited region, the invention is extremely safe to use.

Other and further features, objects, advantages, and benefits of the invention will become apparent from the following description taken in conjunction with the following drawings. It is to be understood that both the foregoing general description and the following detailed description are exemplary and explanatory, but are not restrictive of the invention. The accompanying drawings, which are incorporated in and constitute a part of the invention, illustrate one embodiment of the invention, and together with the description, serve to explain the principles of the invention.

DETAILED DESCRIPTION OF THE DRAWINGS

FIG. 1 is a side elevation view of the invention illustrating it in posed position ready for operation;

FIG. 2 is an end elevation view of the invention illustrated in FIG. 1.

FIG. 3 is a side elevation view, similar to FIG. 1, illustrating the invention near the completion of a stroke;

FIG. 4 is a cross section view of the invention taken generally along the line 4—4 of FIG. 2.

FIG. 8 is a detail side elevation view of certain parts in an inactive position;

DESCRIPTION OF THE PREFERRED EMBODIMENTS

Figure 5:
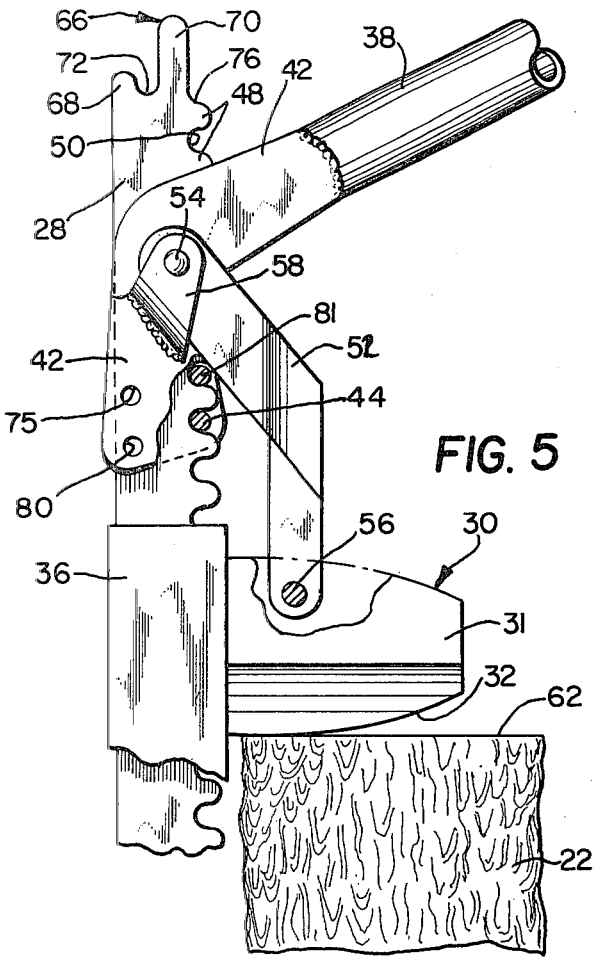
FIG. 5 is a detail side elevation view of certain parts shown in FIG. 1, with the parts generally positioned as illustrated in FIG. 1.

Refer now to the drawings, and initially to FIGS. 1 and 2, which illustrate apparatus embodying the principles of the present invention. As seen in FIGS. 1 and 2, an improved log splitter is identified by the reference numeral 20 which is suitably positioned to operate upon a log 22 which has been previously cut to a length acceptable for use in a fireplace or stove.

In accordance with the invention, the apparatus being disclosed as the invention comprises a base including a platform for supporting on end a log about to be split, the log having an upper end and a lower end; a post mounted on said base and extending upwardly therefrom; an operating member having a downwardly directed cutting edge and lateral surfaces which diverge outwardly with increased distance from said cutting edge and an integral guide member slidably mounted on said post for movement along the length thereof; a handle having a longitudinal axis movable between a raised position and a lowered position including a free end and a pair of finger members at its opposite end; a fulcrum pin mounted to said finger members and extending transversely thereof; a plurality of teeth integral with said post at spaced locations along the length thereof, said teeth extending outwardly from said post in a direction generally toward the log, adjacent ones of said teeth defining recesses therebetween being sufficient in size to loosely receive said pin therein; a link having opposite ends pivotally mounted, respectively, to said handle and to said operating member, said fulcrum pin being selectively engageable with said post in an appropriate one of the recesses when said cutting edge is rested upon the upper end of the log, said link being operable for simultaneously applying maximum force to and causing minimum movement of said operating member when said handle is in its raised position for simultaneously applying minimum force to and causing maximum movement of said operating member when said handle is in its lowered position, whereby a force applied to said free end of said handle in a direction transverse of said longitudinal axis causes rotation of said handle about said fulcrum pin from the raised position toward its lower end with continued rotation of said handle.

As embodied herein, with reference now to FIGS. 1–4, the log splitter 20 is seen to include a base 24 which is illustrated as being fabricated from a single length of bar stock suitably bent to provide stability both longitudinally and laterally, the opposite ends of the bar stock being drawn together and fastened by means of a suitable fastener 25. An upper surface of the base 24 serves as a platform 26 upon which the log 22 can be supported on end. The fastener 25 also serves to mount to the base 24 a post 28 which extends in an upward direction.

Figure 6:
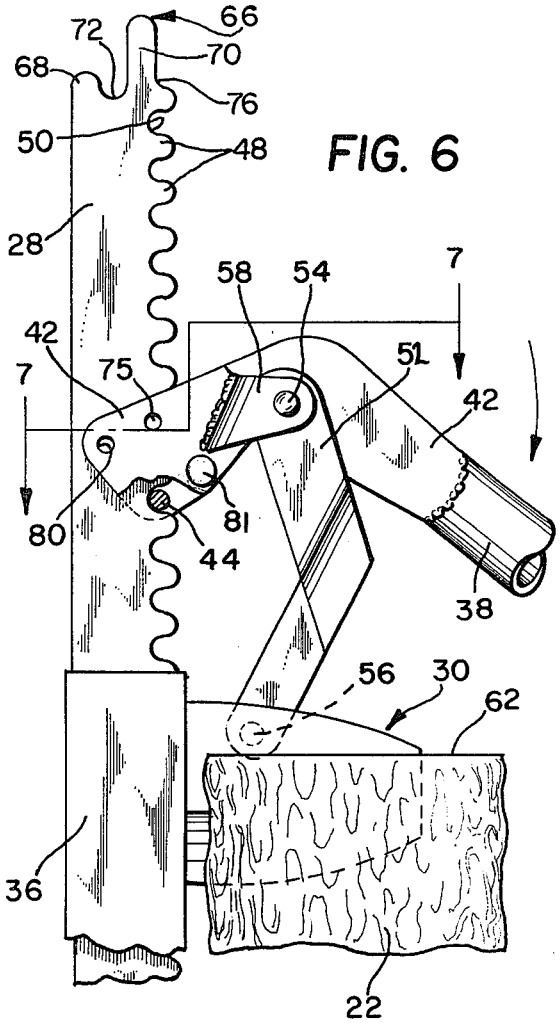
FIG. 6 is a detail side elevation view of certain parts shown in FIG. 3, with the parts generally positioned as illustrated in FIG. 3.
Figure 7:
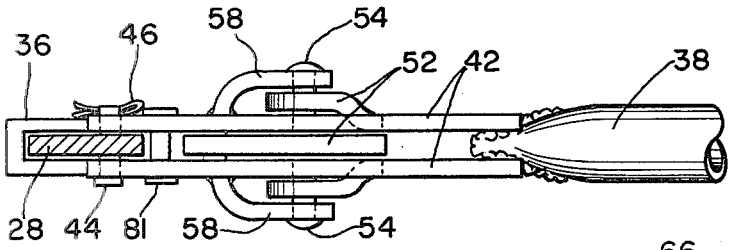
FIG. 7 is a cross section view taken generally along line 7—7 in FIG. 6.

With reference now to FIGS. 5 and 6, an operating member 30, a portion of which takes the form of an axe head or wedge 31, is provided with a downwardly directed cutting edge 32 and opposed lateral surfaces 34 which diverge outwardly with increased distance from the cutting edge 32. A guide member 36 formed integral with the operating member 30 has a generally rectangular cross section (see FIG. 7) so as to be slidably received over the post 28 and is movable along the entire length of the post from the base 24 upward and, indeed, can even be removed from the upper end of the post, if desired.

The log splitter 20 is actuated by means of a handle 38 which is elongated and has a longitudinal axis movable between a raised position (FIGS. 1 and 5) and a lower position (FIGS. 3 and 6). The handle extends from a free end 40 to an opposite or working end defined by a pair of finger members 42 which are integral with the remainder of the handle. The finger members 42 are suitably pierced to receive a fulcrum pin 44 which extends transversely of the finger members and across the spacing between them. Although the construction of the log splitter may be such that the fulcrum pin 44 is removably fixed to the finger members 42 and held in place, as by a cotter pin 46, it is also within the scope of the invention for the fulcrum pin 44 to be welded or otherwise firmly fixed to the finger members 42.

With continued reference particularly to FIGS. 5 and 6, it is seen that a plurality of teeth 48 are formed integral with the post 28 at spaced locations along its length, the teeth extending outwardly from the post in a direction generally toward the log 22 which is about to be split. The spacing between the teeth is such as to define recesses 50 of a suitable size to receive, in a loose fashion, the fulcrum pin 44 between each adjacent pair of teeth.

Connecting the handle 38 and the operating member 30 is a link 52. Pins 54 suitably connect each of the finger members 42 of the handle 38 to its associated portion of the link 52, while a pin 56 suitably connects the link 52 to the operating member 30. Ears 58 (FIG. 7) may be provided for increased strength at a critical location, as illustrated. Specifically, an ear 58 would be mounted to each finger member 42 as by welding, or the like, and suitably formed and pierced to pivotally receive the pin 54. Additionally, the construction including the ears 58 and the bifurcated link 52 and separate pins 54 allow for positioning of the handle 38 in the raised position so as to substantially align the pins 54, 44 and 56.

In operation, the log splitter 20 initially assumes a poised position as generally illustrated in FIGS. 1 and 5. As shown, a cut log 22 is placed in position adjacent to the post 28 with a lower end 60 resting on the platform 26 of the base 24. With the guide member 36 slidably received on the post 28, and with the aid of gravity, the user lowers the operating member 30 by means of the handle 38 until the cutting edge 32 rests on an upper end 62 of the log 22. The fulcrum pin 44 is inserted into an appropriate recess 50 on the post 28 and, when this has been accomplished, the pins 54, 44 and 56 (see FIG. 5) are substantially aligned, the handle 38 being in a raised position.

As a transverse, or downward, force is applied to the handle 38, it swings in the direction of an arrow 64 (see FIG. 3) from a raised position (FIG. 1) toward and through a horizontal position to a lowered position (FIG. 3). By reason of the construction of the link 52 and the positioning of the pins 54, 44 and 56 such that they are substantially aligned at the outset of movement of the handle 38, maximum force but minimal movement is applied to the pins 54 and 56 and, therefore, to the operating member 30 and to the cutting edge 32. However, with continued downward movement of the handle 38, the mechanical advantage enjoyed by the pins 54 and 56 continues to diminish with a resultant continuing decrease in the force being applied to the operating member 30 and to the cutting edge 32. However, as the force being applied to the operating member 30 decreases, the rate at which the cutting edge 32 advances through the log continues to increase, at least until the handle 38 is in a lowered position, as generally represented in FIGS. 3 and 6.

In the event the log 22 is not split by the time the handle 38 reaches the lowered position as generally shown in FIGS. 3 and 6, the same operation can be repeated by removing the fulcrum pin 44 from the recess 50 used for the first stroke and inserting it in another recess closer to the base 24. This operation can be continued as many times as is necessary until the log has been fully split, although under most circumstances twice would be sufficient. In some instances, it may not be necessary to insert the fulcrum pin 44 into another recess for another stroke. The reason is that the mere weight of the handle and operating member may be sufficient, when dropped, to drive the cutting edge 32 through the remainder of the log 22. Of course, the log splitter 20 could be utilized in this latter fashion as well when splitting relatively small kindling.

In accordance with the invention, the log splitter 20 is generally as previously described wherein said post includes an upper end, rest means including a notch at said upper end adapted to loosely receive said fulcrum pin therein for supporting said handle and said operating member in preparation for placement onto said platform of another log to be split. As embodied herein, with particular reference to FIG. 8, an upper end of the post 28 is generally indicated by reference numeral 66. A pair of finger members 68 and 70 define between them a notch 72 which is adapted to loosely receive the fulcrum pin 44. A pin 74, preferably of the removable variety, is suitably mounted to the finger members 42 being received through holes 75 (FIG. 9) and extending across the space between them. When the fulcrum pin 44 is received in the notch 72, the pin 74 rests against a rear surface 76 of the finger member 70 on the post 28. In this manner, the operating handle 38 and the operating member 30 can be held in an inactive or rest position ready for application of the next stroke, yet sufficiently distant from insertion of a new log to be split. When a new log 22 has been properly placed onto the platform 25 the fulcrum pin 44 is lifted from the notch 72 by means of the handle 38 and swung over the finger member 70. The operating member 30 is then permitted to descend until the cutting edge 32 is in contact with the upper end 62 of the log 22.

Figure 9:
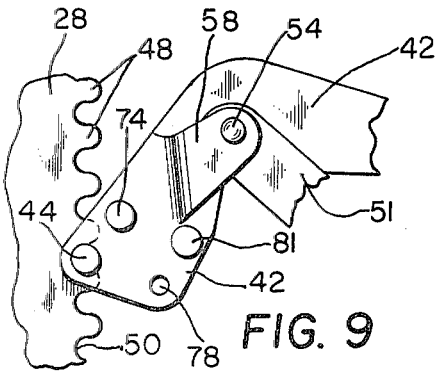
FIG. 9 is a detail side elevation view showing a modified use of the invention.

In accordance with the invention, the log splitter 20 is generally as previously described wherein each of said finger members has a first hole and a second hole spaced therefrom, and wherein said fulcrum pin can be received, selectively, through the first holes and through the second holes and be removably secured to said finger members whereby placement of said fulcrum pin through the first holes results in applying substantially maximum force to said operating member while causing a minimum of downward movement thereof and placement of said fulcrum pin through the second holes results in applying a reduced force to said operating member while causing increased downward movement thereof. As embodied herein, with particular reference to FIGS. 8 and 9, the finger members 42 are illustrated as each having a first hole 78 (FIG. 8) and a second hole 80 (FIG. 5) or through the second holes 80 (see FIG. 9) in order to achieve the effect desired by the user. It will be appreciated that by placement of the fulcrum pin 44 in the first holes 78, maximum force of the operating member is achieved for a given amount of movement of the handle 38 while placement of the fulcrum pin in the second holes 80 achieves a reduced force being imparted to the operating member, but may be adequate for the purposes of the user in a given situation. It will also be appreciated, that in order for the pin 44 to be utilized in the hole 78 as indicated in FIG. 9, the pin 74 will have been previously removed from its associated hole 75.

Additionally, in order to provide for the rest position of the operating handle 38 and the operating member 30 when the fulcrum pin 44 is received in the first holes 78 (FIG. 9), a pin 81 is provided which may be of the fixed variety mounted to the finger members 42 and extending across the space between them. Thus, when the fulcrum pin 44 extends through the holes 78 and is received in the notch 72, the pin 81 rests against the rear surface 76 of the finger member 70 on the post 28.

In accordance with the invention, the log splitter 20 is generally as previously described including a second handle having a free end; hinge means pivotally mounting said second handle at an end opposite said free end to said base at a location distant from said post; tensile means connecting said handle to said second handle and extending from said handle at a location distant from said fulcrum pin to said second handle at a location distant from said post such that said operating member is caused to move downwardly into and through the upper end of the log in response to a downward force applied to said free end of said second handle causing rotation thereof about said hinge means.

Figure 10:
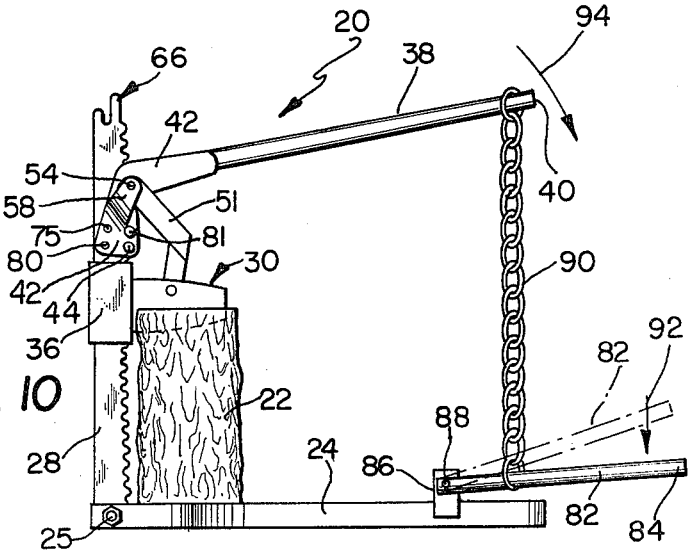
FIG. 10 is a side elevation view of a modified form of the invention.

As embodied herein, with particular reference now to FIG. 10, a second handle 82 has a free end 84 and an opposite end 85 mounted to the base 24 by means of a suitable hinge 88 located distant from the post 28. A suitable tensile member 90 extends between the handle 38 adjacent its free end 40 and the second handle 82 at some distance inboard from the hinge 88. The tensile member 90 may be of any material suitable for the purpose, including rope, chain links, or the like. The opposite ends of the tensile member 90 are secured to the handle 38 and the second handle 82 in any suitable manner which prevents its movement longitudinally of the handle and second handle, respectively. By rotating the second handle 82 about the hinge 88 in the direction of an arrow 92, movement of the handle 38 is achieved in the direction of an arrow 94. The purpose of the second handle 82 is to improve upon the mechanical advantage already provided by the handle 38. Otherwise, the operation of the log splitter 20 is generally as previously described.

Figure 11:
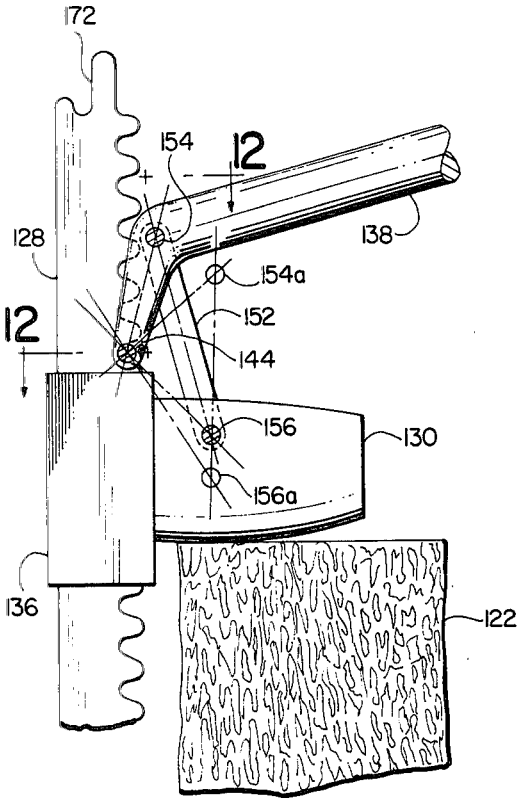
FIG. 11 is a side elevation view of an alternative embodiment.
Figure 12:
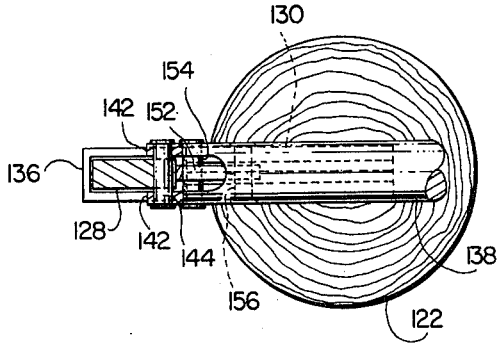
FIG. 12 is a horizontal sectional view taken on the line 12—12 of FIG. 11.

Turning now to the FIGS. 11 and 12 embodiment, the base (not shown) is preferably identical to that shown in FIGS. 1–10 and may include a second lever and chain as shown in FIG. 10 to gain added mechanical advantage from the two lever combination as described above.

The post 128 is similar to post 28 described above, and blade 130 is also similar to that described above, having a sleeve portion 136 slidably received on post 128 as shown in FIGS. 11 and 12. Teeth on post 128 define recesses therebetween to receive a fulcrum pin so that the handle or lever 138 can be positioned in an upwardly inclined position similar to that for handle 38 in FIG. 1 when a log 122 is engaged by the edge of blade or wedge 130.

The FIG. 11 lever 138 has a free end (not shown) and an inner or lower end which defines a depending crank arm 142 in the form of a yoke as best shown in FIG. 12. The portions 142, 142 are received on either side of the post as shown so that an intermediate portion of fulcrum pin 144 is adapted to be received in one of said recesses in said post so that the lever is movable from the upwardly inclined position shown to a position at or below the horizontal.

FIG. 11 shows the latter position somewhat schematically to illustrate that the link 152 for pivotally connecting the lever 138 to the blade 130 does provide maximum mechanical advantage for the user at the initial contact between blade 130 and log 122.

The triangle formed by these three points, fulcrum pin 144 and the pivoted ends of link 152, will initially take an oblique triangle shape of minimum area to maximize the mechanical advantage and this triangular shape will gradually increase in area to correspondingly decrease the mechanical advantage as the upper end of link 152 moves horizontally away from fulcrum pin 144. As the handle or lever 138 reaches the horizontal this upper end of link 152 will move to the position shown at **154*a* and the lower end of link 152 will move to the position 156*a* to form a somewhat larger triangle as shown in FIG. 11**.

FIGS. 5 and 6 show the same triangular geometry for the first embodiment, and it will be apparent that the significant feature of the invention embodied in both versions is that maximum downward force at the wedge or blade will be achieved at initial contact with the log rather than resorting to the more cumbersome designs of the prior art such as illustrated in U.S. Pat. No. 4,277,407 wherein a much longer base supports the blade or wedge on an elongated lever instead of providing the blade on a sleeve directly on the post as in the subject disclosure.

Figure 13:
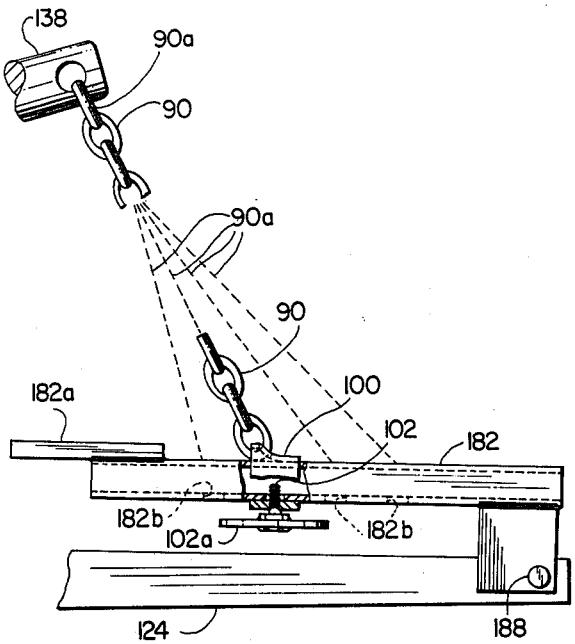
FIG. 13 is a side elevational view of an alternative version of the second lever shown in FIG. 10.

FIG. 13 shows an alternative version of the second, or foot lever, such as suggested in FIG. 10. The lever 124 is pivotally connected to the end of base 124 at 188, but is oppositely directed from that of the FIG. 10 version. Lever 182 is also adapted to be foot operated at its free end **182*a* but this foot or free end 182*a* is located between the post 128 and the pivot 188 rather than outside the pivot 88 as suggested in FIG. 10**.

The chain 90 is connected to the hand operated lever 138, preferably by means of clevis **90*a*, but other equivalent connections can be made to the handle 138. The lower end of chain 90 is connected to a slide member 100 which can be adjustably located on lever 182 by means of the screw 102. The head portion 102*a* of screw 102 is oversized to facilitate loosening of screw 102 in a threaded opening of slide 102 such that the lower end of chain 90 can be relocated on lever 182 to vary the mechanical advantage achieved with the improvement of FIG. 13**.

More particularly, lever 182 is of tubular cross section, and has several openings **182*b*, 182*b* in its lower wall to receive the inner or upper end of screw 102 in any one of several possible positions. As suggested by the broken lines 90*a*, 90*a* this will permit the user to change the line of action of the chain 90 in order to vary the distance for the chain line of action from fulcrum or pivot pin 188**.

The invention, in its broader aspects, is not limited to the specific details shown and described; departures may be made from such details without departing from the principle of the invention and without sacrificing its chief advantages.

I claim:

1. Apparatus for splitting firewood comprising:

a base for supporting a log to be split, a post mounted to said base and havng teeth in one edge, which teeth project toward the log and define recesses therebetween, a sleeve slidably received on said post, a blade of wedge shape mounted on said sleeve and adapted to split a log as a result of downward movement of said sleeve and blade along said post, an operating lever with a free end and an end defining a depending crank arm forming a yoke with portions on either side of said post, a fulcrum pin adjacent the lower ends of said depending crank arm yoke portions and an intermediate portion of said fulcrum pin adapted to be received in one of said recesses between said teeth so that said lever is pivotally movable from an upwardly inclined position to a position at or below the horizontal, a link having its upper end pivotally connected to said lever at a point spaced above said fulcrum pin, said upper pivoted end of said link located adjacent said teeth of said post when said lever is in said upwardly inclined position, said link having an opposite lower end pivotally connected to said blade generally below said fulcrum so that said pivoted ends of said lever and said fulcrum pin form an oblique triangle in the upwardly inclined lever position and assume a triangular shape of larger area as said handle is moved downwardly to split a log.

2. Apparatus as set forth in claim 1 further characterized by upwardly open notch means at the upper end of said post to receive said fulcrum pin and to support said blade and lever in an inactive position to allow placement of another log on said base for splitting.

3. Apparatus as set forth in claim 1 further including a second lever pivotally connected to said base and having a free end, and means connecting said second lever to said free end of said operating lever to gain a mechanical advantage from the resulting lever combination.

4. Apparatus as set forth in claim 3 wherein said means connecting said levers comprises a chain with one end connected to said operating lever, and a slide releasably secured to said second lever and connected to an opposite end of said chain so that the mechanical advantage so achieved can be increased and decreased as a result of said lever combination.

* * * * *